US005795194A

United States Patent [19]

Hahn

[11] Patent Number: 5,795,194

[45] Date of Patent: Aug. 18, 1998

[54] ELECTRICAL CONNECTOR WITH V-GROOVES

[75] Inventor: Marlyn E. Hahn, York, Pa.

[73] Assignee: Berg Technology, Inc., Reno, Nev.

[21] Appl. No.: 882,365

[22] Filed: Jun. 25, 1997

Related U.S. Application Data

[63] Continuation of Ser. No. 536,646, Sep. 29, 1995, abandoned.

[51] Int. Cl.[6] ..... H01R 17/00

[52] U.S. Cl. ..... 439/660; 29/874

[58] Field of Search ..... 439/626, 79, 660, 439/634, 686, 701, 290, 284; 29/829, 837, 874, 882

[56] References Cited

U.S. PATENT DOCUMENTS

| | | | |
|---|---|---|---|
| 4,392,705 | 7/1983 | Andrews, Jr. et al. | 439/79 |
| 4,483,581 | 11/1984 | Kourimsky et al. | 439/634 |
| 4,764,130 | 8/1988 | DiClemente | 439/686 |
| 4,780,090 | 10/1988 | Sugiyama et al. | 439/247 |
| 4,937,653 | 6/1990 | Blonder et al. | 29/25.35 |
| 5,057,028 | 10/1991 | Lemke et al. | 439/101 |
| 5,116,247 | 5/1992 | Enomoto et al. | 439/660 |
| 5,176,530 | 1/1993 | Reylek et al. | 439/290 |
| 5,199,880 | 4/1993 | Arai | 439/65 |
| 5,214,308 | 5/1993 | Nishiguchi et al. | 29/837 |
| 5,380,225 | 1/1995 | Inaoka | 439/660 |
| 5,572,779 | 11/1996 | Adelman et al. | 29/874 |

*Primary Examiner*—Gary F. Paumen
*Assistant Examiner*—Tho Dac Ta
*Attorney, Agent, or Firm*—Herzog, Crebs and McGhee, LLP

[57] ABSTRACT

An electrical plug has a multiplicity of contact terminals disposed on a wafer that is received within a housing. The wafer or substratum is grooved or channeled between each contact terminal. In this manner, the contacting surface of each terminal is essentially raised from the surface of the substratum. Generally, the groove takes the form of a modified V shape, however, other groove configurations may be utilized. By lowering the substratum surface during formation of the wafer, the contact surface of each terminal becomes elevated from the substratum surface, while remaining at the same height relative to each other. Any misregistration or misalignment of the terminals of the receptacle caused by tilting, twisting or otherwise that would cause an open circuit or poor contact is alleviated by the channel. The misaligned receptacle terminal is allowed to tilt and be received into the channel rather than contacting the substratum surface to be held away from contact.

18 Claims, 4 Drawing Sheets

ELECTRICAL CONNECTOR WITH V-GROOVES

This is a continuation of application Ser. No. 08/536,646, filed Sep. 29, 1995 now abandoned.

FIELD OF THE INVENTION

The present invention relates to electrical connectors and, more particularly, to electrical connectors having terminal contacts embedded on wafer substrates.

BACKGROUND OF THE INVENTION

Electrical connectors comprising plugs and receptacles for connecting wires from various devices or sources to other devices have evolved over the years as advances in technology have changed those devices or sources. Different applications have also required new and varied types of connectors. Most notably, with the advent of computers and related peripherals, electrical plugs or connectors have been developed to releasably link the cables or wires necessary to carry and communicate information from one device or source to another device. In some cases, circuit boards, either alone or integral with the device, may be coupled to other circuit boards.

Electrical connectors for the computer industry must now be able to connect a multiplicity of wires from one source or device to another source or device. These connections are now so closely bundled on the plugs or receptacles in order to conserve space, that the connection elements or terminals are very narrowly spaced. Imprecise or misaligned terminals upon connection of the receptacle to the plug may cause misregistration of the contacts.

Such misregistration of the contacts may create an open circuit between the individual contacts or a poor connection therebetween. An open circuit means that no signal can pass between the plugs which would most likely cause a system malfunction or misoperation of the coupled devices. The poor connection may likewise cause a system malfunction or misoperation of the coupled devices.

Generally, such misregistration occurs through misaligned receptacle terminals relative to the plug terminals. The receptacle terminals are usually wires that can become tilted or twisted. The plug has flat terminals embedded on a wafer. It is the misregistration between the receptacle terminals and the plug terminals that can cause the above-noted problems.

The insert molded plug contacts or terminals of the prior art are designed to be at the same level as the plastic wafer substratum on which the contacts or terminals are located. Because of this prior art architecture, misregistration of the receptacle or a slight twist or tilt of the receptacle terminals relative the plug will cause the receptacle terminals to ride up on the substratum between adjacent terminals thereby creating the open circuit or misaligned condition.

It is therefore an object of the present invention to provide an electrical connector that establishes reliable electrical performance.

It is another object of the present invention to provide an electrical plug that alleviates open circuit conditions between the terminals of the mating connectors upon slight misalignment of the terminals of the mating receptacle relative to the contacts of the plug.

It is further an object of the present invention to provide an improved terminal carrying wafer substrate that helps alleviate poor electrical contact between a plug and receptacle such as is caused by misregistration of the respective terminals.

SUMMARY OF THE INVENTION

The present invention is an electrical plug of the type having a wafer or substratum on which is disposed a multiplicity of terminal contacts. The wafer is insertable into a housing or frame to form the electrical plug. The terminal contacts are disposed on the substratum in a spaced apart adjacent manner.

Between adjacent terminal contacts is a groove or channel in the substratum such that the top surface of the terminal contact is elevated from the top surface of the substratum. The groove may be a modified V shape or otherwise. By making the top surface of the terminal contacts elevated from the surface of the substratum, misregistration of any terminal contact of a received receptacle will still make electrical contact with the terminal contact of the plug by allowing the received terminal contact to extend into the groove, rather than riding up on the surface of the substratum causing an open circuit or poor connection circuit, as it would with the prior art same level design. The groove thus lowers the plug plastic surface below the contact surface.

In the preferred embodiment, the electrical plug includes two wafers each with a multiplicity of terminal contacts. The wafers are disposed parallel to one another in the housing.

According to an aspect of the present invention, the wafer substratum is insert molded about the terminals such that each terminal contact surface is elevated from the substratum surface while being co-planar relative to each other.

The plug or header is especially designed for a line of high-performance, low-crosstalk interconnections in high-speed, digital system applications, known as Micropax™ by Berg Electronics of Camp Hill, Pa. The plug is available in four mounting configurations: straddle-mount, vertical through-mount, surface-mount, and right angle mount. The plug is designed to function as a transmission line along with its mating receptacle, by the geometry of the contacts and their spacing relative to each other, the dielectric substratum, and ground.

Additionally, the contacts of the plug are plated with an exclusive Berg palladium nickel alloy with gold flash (known as Berg GXT™) for better solderability, porosity, environmental corrosion resistance, and bend ductibility.

BRIEF DESCRIPTION OF THE DRAWINGS

So that the manner in which the above-recited features, advantages, and objects of the present invention are attained and can be understood in detail, a more particular description of the invention, briefly summarized above, may be had by reference to the embodiments thereof which are illustrated in the appended drawings.

It is noted, however, that the appended drawings illustrate only a typical embodiment of this invention and is therefore not to be considered limiting of its scope, for the invention may admit to other equally effective embodiments. Reference the appended drawings, wherein.

DETAILED DESCRIPTION

Figure 1:
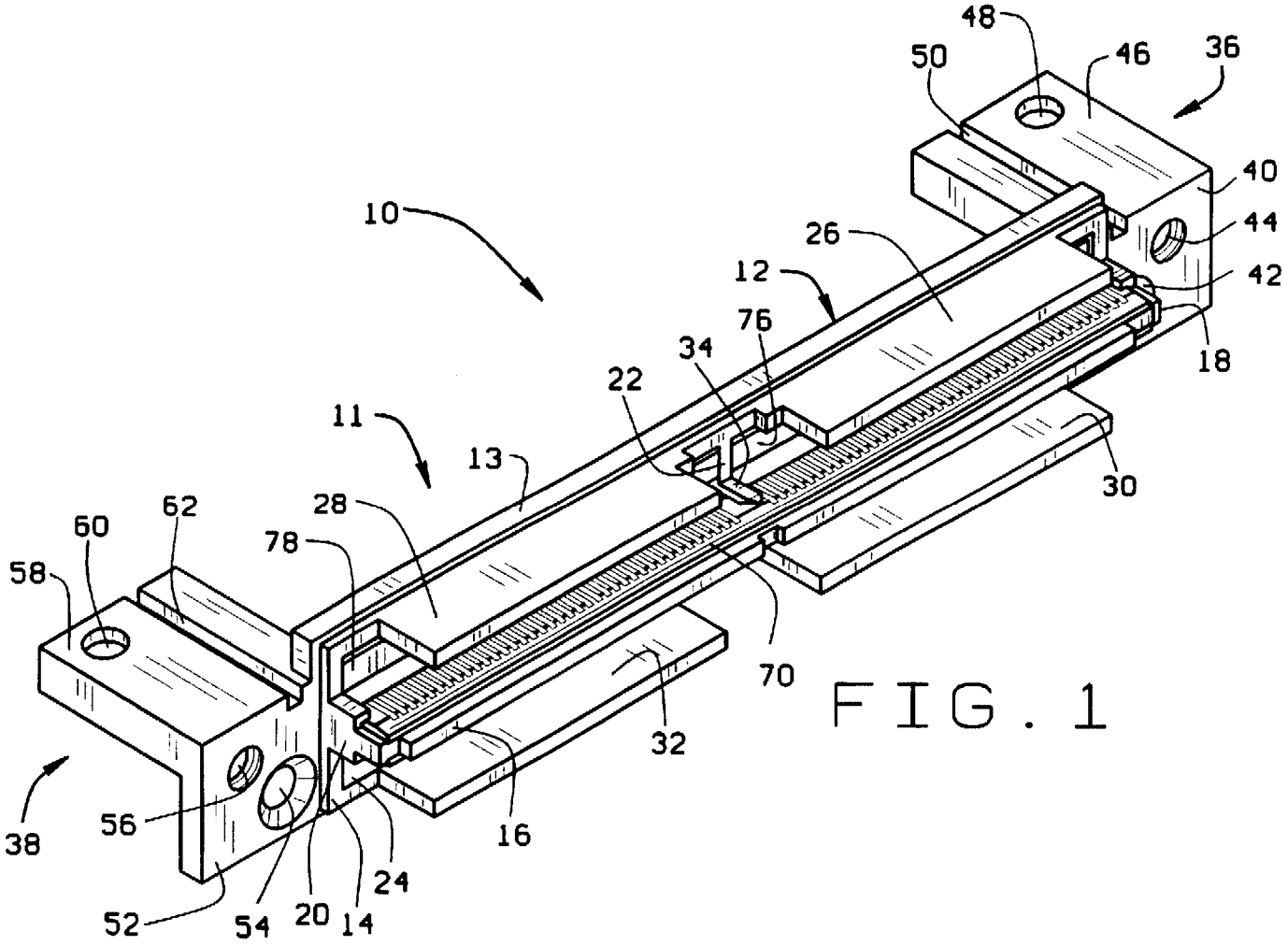
FIG. 1 is a perspective view of an electrical connector plug embodying the present invention.
Figure 2:
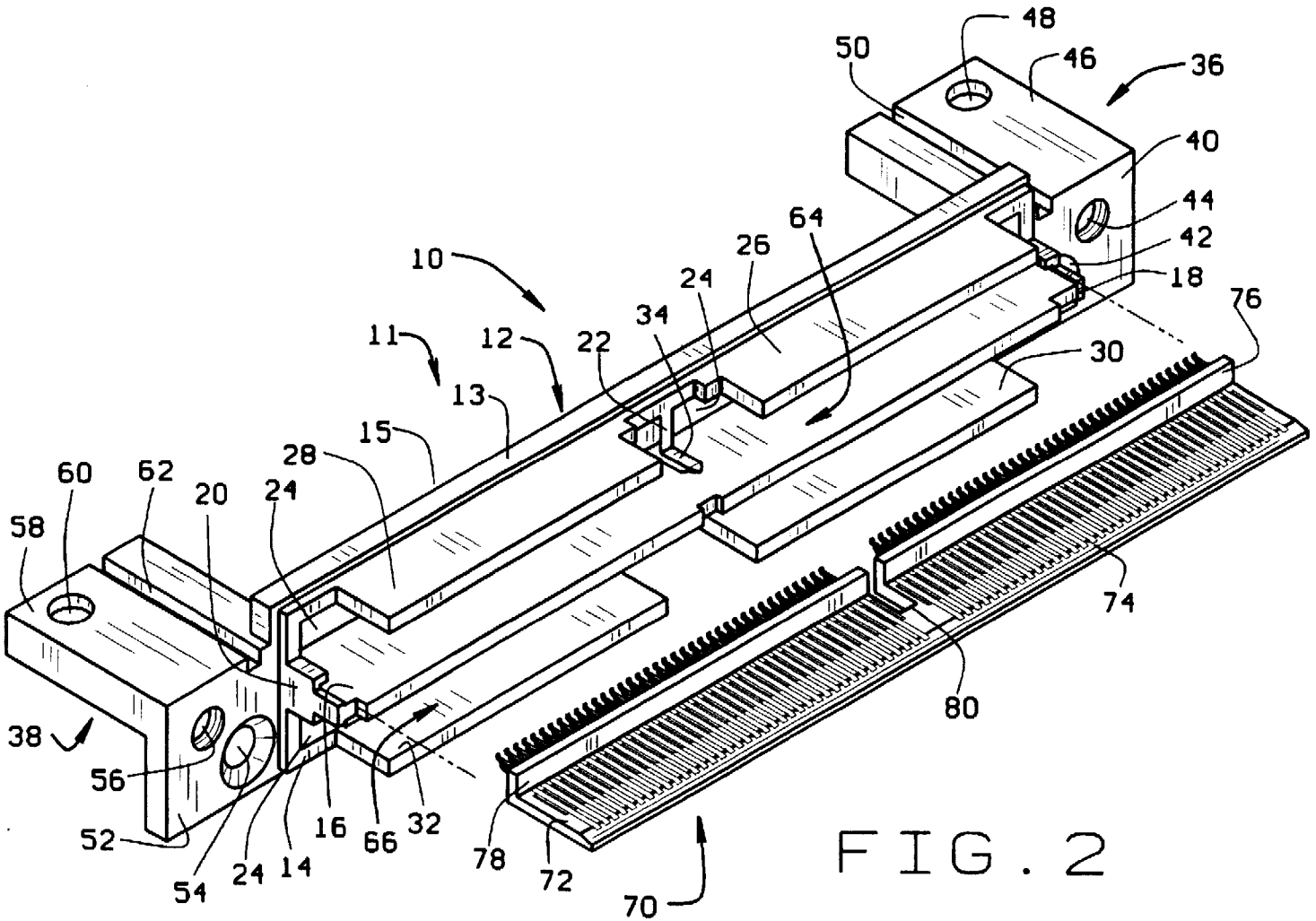
FIG. 2 is a perspective view of the plug of FIG. 1 with one contact wafer in exploded view.

Referring now to FIGS. 1 and 2 there is shown an electrical connector known as a plug generally designated 10 that is designed and adapted to receive a second electrical connector (not shown) known as a receptacle. The plug 10 is shown as a straddle-mount type plug. It should be understood that the present invention is directed towards the terminals and their substratum, and while it is shown in the straddle-mount plug 10, the principles of the present invention may equally apply to vertical through-mount or surface-mount plugs, to the receptacles therefor or to other types of electrical connectors. The plug 10 is defined by a one-piece housing, frame, or casing structure 11 preferably made of a die-cast metal such as zinc. The housing includes a rectangular frame 12 having an upper longitudinal rail 13, a lower longitudinal rail 14, and a central longitudinally oriented, shelf-like member 16. The central member 16 is connected to the short sides of the rectangular frame 12 by a right and left flange 18, 20 respectively. Disposed transverse to and at the middle of the central member 16 is a divider 22. The rectangular frame 12, the central member 16, and the divider 22 define four rectangular openings 24, of which only three such openings are discernable in the figures.

Extending outwardly from the upper longitudinal rail 13 of the frame 12 is an upper right side shelf 26 and an upper left side shelf 28. Likewise, extending from the lower longitudinal rail 14 of the frame 12 is a lower right side shelf 30 and a lower left side shelf 32. The shelves 26, 28, 30, and 32 cooperate with the central member 16 and divider 22 to more clearly define the openings 24 during placement or the receipt of the mating receptacle therein. The shelves 26, 28, 30, and 32 also serve as electrical shielding and protection against electrostatic discharge, as well as promoting high-speed performance and optimizing signal density. However, the present invention is not directed towards nor does it utilize these features and characteristics. Therefore, they will only be mentioned here as a matter of geometry. Transversely extending from the divider 22 are two obelisk-shaped spikes, of which only one spike 34 is shown, for wafer orientation.

The casing 11 also includes a right mounting bracket 36 defined by a front face member 40 and a transverse top face member 46. The front face member 40 includes a countersunk bore 42 into which a receptacle guide pin (not shown) of the mating connector (not shown) is received for proper alignment of the connectors. A threaded bore 44 is also disposed in the front face member 40 to receive a screw of a mating receptacle (not shown) in order to secure the mating receptacle to the casing 11. The top face member 46 includes a threaded bore 48 and a channel 50 for mounting purposes.

The casing 11 further includes a left mounting bracket 38 defined by a front face member 52 and a transverse top face member 58. The front face member 52 includes a countersunk bore 54 into which a receptacle guide pin (not shown) of the mating connector (not shown) is received for proper alignment of the connectors. A threaded bore 56 is also disposed in the front face member 52 to receive a screw of a mating receptacle (not shown) in order to secure the mating receptacle to the casing 11. The top face member 58 includes a threaded bore 60 and a channel 62 for mounting purposes.

Overall, the casing 11 is thus adapted to be attached to a board, device, or peripheral (not shown) such that other devices or sources may be connected thereto for data or signal transmitting and/or receiving.

By virtue of the center section 16 and the shelves 26, 28, 30, 32, the frame 12 is thus divided into two longitudinal channels, an upper channel 64 and a lower channel 66. With particular reference to FIG. 2, each channel 64, 66 is adapted to receive a terminal carrying wafer, of which only one such wafer 70 is shown. The wafer is shown in exploded view extricated from the upper channel 64. The wafer 70 is thin, longitudinal and made of a dielectric, preferably plastic, that withstands IR, wave, and vapor-phase soldering. As both wafers are identical, only one wafer will be described in detail hereinbelow.

Figure 3:
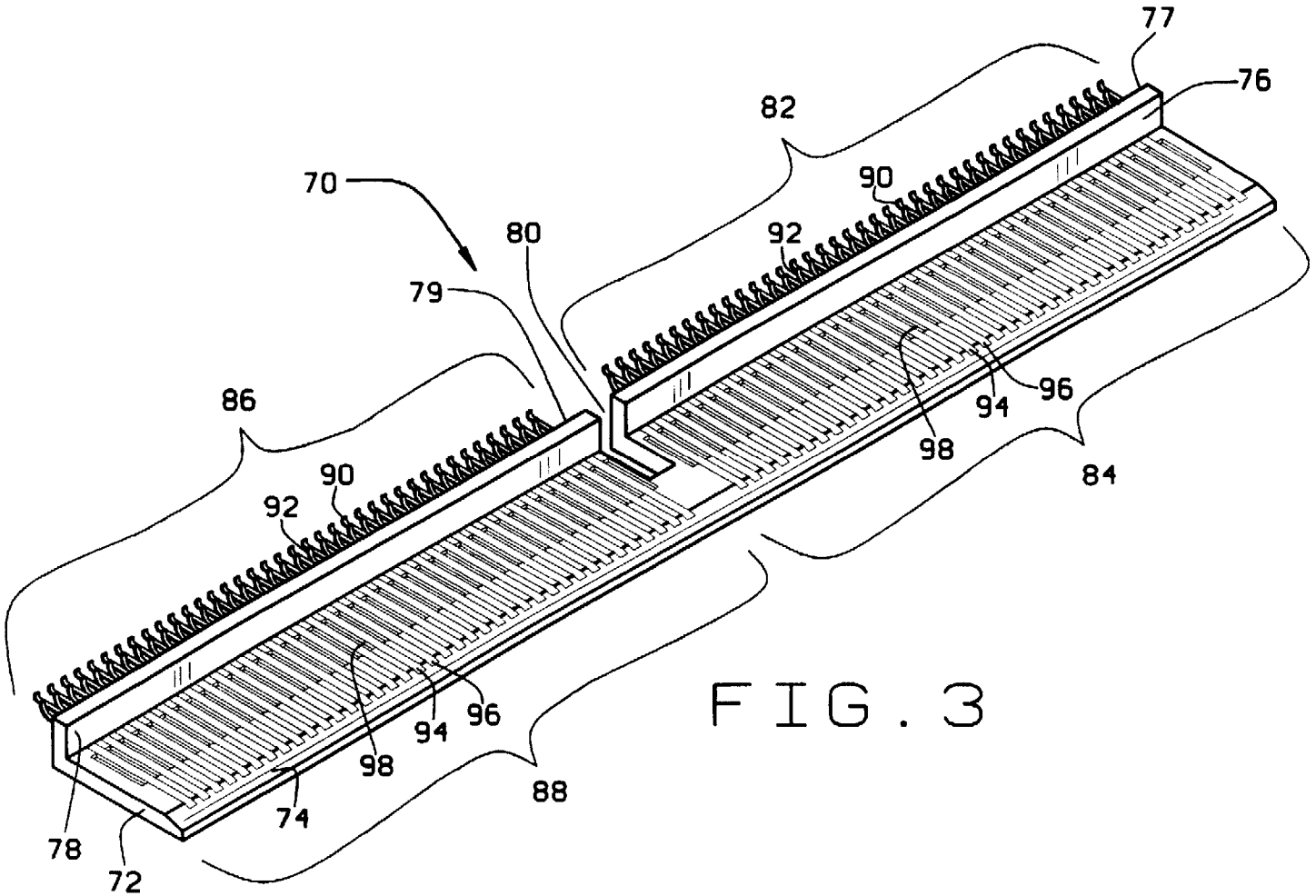
FIG. 3 is an enlarged perspective view of one of the contact wafers.

Referring specifically to FIG. 3, an enlarged single wafer 70 is shown. The wafer 70 is comprised of a substratum 72 that includes a front taper 74 that extends the entire front longitudinal length of the wafer 70. At the longitudinal end opposite the taper 74 are two transverse ledges or shoulders, a right ledge 76 and a left ledge 78. The height of the ledges 76, 78 correspond to the height or size of the openings 24 defined in the casing 11. Intermediate the ledges 76 and 78, thereby defining the two ledges, is a notch 80. When the wafer 70 is inserted into the respective longitudinal channel 64, 66, the transverse member 22 is received in the notch 80. The depth of the notch 80 is such that the longitudinal rears 77, 79 of the respective ledges 76, 78 are flush with the end 15 of the rectangular frame 12.

Extending from the rears 77, 79 of respective ledges 76, 78 are two banks of leads or solder-tails 82, 86 respectively. The two banks of the solder-tails 82, 86 are continuations of two banks of terminals or contacts 84, 88, respectively, that are disposed on the substratum 72. The contact bank 84 corresponds to the solder-tail bank 82, while the contact bank 88 corresponds to the solder-tail bank 86 such that the solder-tails are a physical extension of the contacts. The solder-tails and contacts are made from a phosphor bronze material coated or plated with an electrically conducting material, preferably a palladium nickel alloy with gold flash, known as GXT™, by Berg Electronics.

Each bank of solder-tails 82, 86 is composed of single adjacent leads of alternating length, with the longer leads designated 90 and the shorter leads designated 92. The length of the leads 90, 92 is only for ease of attachment to a board or otherwise and can be the same length. Each contact bank 84, 88 consists of a multiplicity of terminals arbitrarily alternatively labeled 94 and 96. The terminals 94, 96 respectively correspond to the long and short solder-tails 90,92. Disposed between each terminal 94, 96 is a groove or channel 98 that is formed during the manufacture of the wafer 70.

Figure 4:
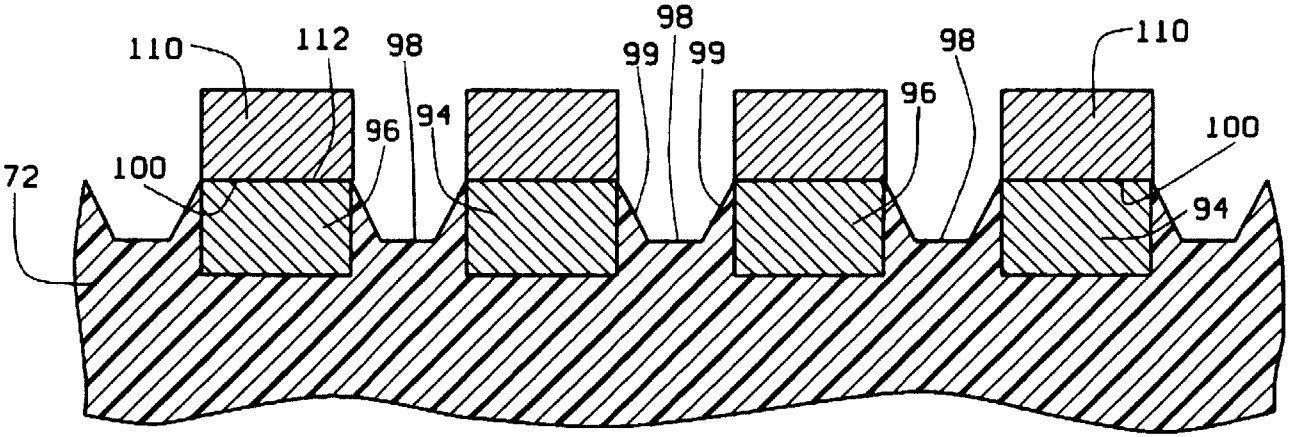
FIG. 4 is an enlarged side cutaway view of the contact wafer depicting the normal registration with terminal contacts of a received receptacle.

According to an aspect of the present invention, and referring additionally to FIG. 4, a cross-section of the wafer 70 is shown. The channel 98 is disposed between each terminal 94, 96 of each contact bank 84, 88 and extends only a portion of the entire length of the contacts 94, 96 towards the right and left ledges 76, 78. The channels 98 are positioned along the contacts 94, 96 to optimize any receptacle contact deviation. In the preferred embodiment, the channel 98 is an inverted, truncated cone or a modified V-shape. The channel 98 is defined by opposite tapering walls 99 that begin at the upper or top surface 100 of each terminal 94 or 96 and extends to a depth of greater than one-half of the terminal thickness. The upper surface 100 is thus raised or elevated from the bottom of the channel 98, while the same height and co-planar relative to each other.

Other shaped channels may likewise be used rather than the one depicted, such as a square channel. However, because of the extremely close tolerances necessary to form a square channel, the present shape is deemed preferable from a manufacturing perspective. The channel 98 is formed during manufacture of the wafer through the mold.

Figure 5:
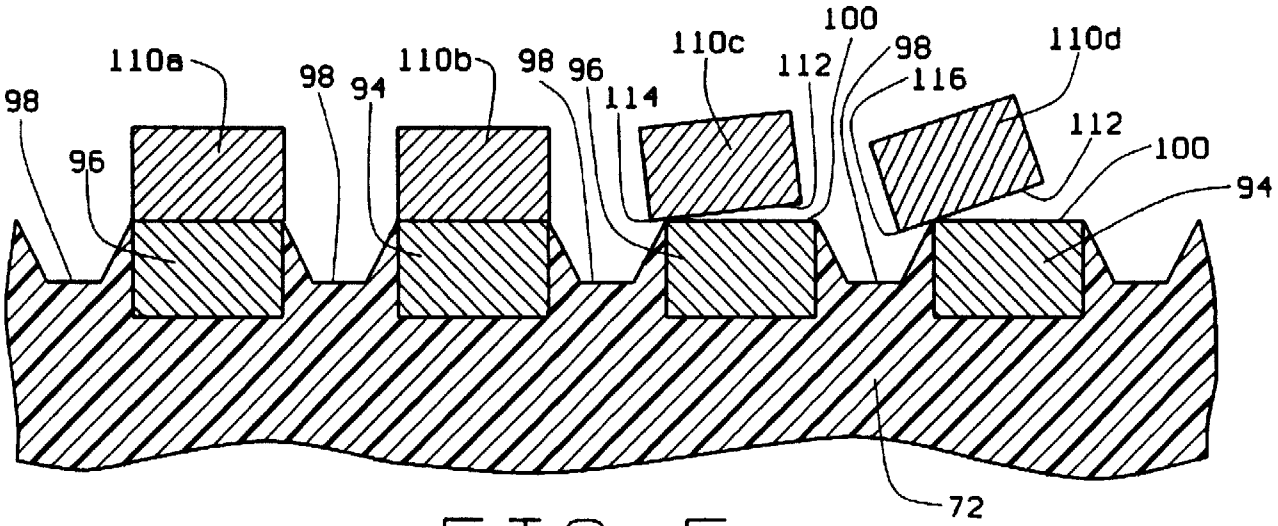
FIG. 5 is an enlarged side cutaway view of the contact wafer depicting misregistration with certain terminal contacts of a received receptacle while still allowing electrical contact between the terminals.

In the normal state of coupling, the leads 110 of the receptacle (not shown) are centrally and angularly aligned such that the full contact surface 112 of the receptacle leads 110 abuts the full contact surface 100 of the plug leads 94 or 96. Referring to FIG. 5, there is depicted several receptacle leads 110 in alignment, 110*a*, 110*b*, and some in misalignment, 110*c*, 110*d*. The lead 110*c* is off-centered and angled from the plane of the contact surface 100. In accordance with the present invention, a portion of the contact surface 112 abuts the contact surface 100 near the edge 1 14, because the edge 114 is received within the channel 98 rather than the substrate 72.

A more extreme example of misregistration or misalignment is depicted with receptacle lead 110*d*. The angle of misregistration and the degree off-center is greater than lead 110*c*. However, in accordance with the teachings of the present invention, the ledge 116 extends into the channel 98, allowing surface 112 to contact surface 100.

While the foregoing is directed to the preferred embodiment of the present invention, other and further embodiments of the invention may be devised without departing from the basic scope thereof, and the scope thereof is determined by the claims which follow.

What is claimed is:

1. An electrical connector for receiving a mating electrical connector of the having a plurality of spaced apart terminals, the electrical connector comprising:

a housing;

a substratum disposed in said housing and defining a surface;

a plurality of spaced apart terminal contacts disposed on said surface of said substratum and terminating in a plurality of solder-tails, said terminal contacts corresponding in number to the plurality of terminals of the mating electrical connector, each of said terminal contacts having a contact surface that is raised from said substratum to define an elevated area wherein said contact surface extends the entire width of said elevated area; and a channel formed in said substratum surface adjacent each of said terminal contacts.

2. The electrical connector of claim 1, wherein said substratum is plastic.

3. The electrical connector of claim 1, wherein said substratum is removably disposed in said housing.

4. The electrical connector of claim 1, wherein said channels extend the length of said terminal contacts.

5. The electrical connector of claim 4, wherein each said channel is substantially V-shaped and has a depth greater than one-half of the thickness of said terminal contacts relative to said contact surface.

6. An electrical plug adapted to receive an electrical receptacle of the type having a plurality of spaced apart terminals, the electrical plug comprising:

a housing;

a substratum disposed within said housing and defining an upper surface;

a plurality of spaced apart terminal contacts arranged longitudinally on said substratum surface, each terminal contact defining a contact surface adapted to abut a respective one of the plurality of spaced apart terminals of the receptacle; and a notch in said substratum surface adjacent to each of said terminal contacts, said notches each having lateral sidewalls that terminate at said contact surfaces and a predetermined depth from said substratum surface such that each said contact surface is raised from said substratum surface to define an elevated area wherein each said contact surface extends the entire width of said elevated area.

7. The electrical plug of claim 6, wherein each said notch extends the longitudinal length of said terminal contacts.

8. The electrical plug of claim 6, wherein each said lateral sidewall is angled such that said notch is substantially V-shaped and said predetermined depth is greater than one-half of the thickness of said terminals.

9. The electrical plug of claim 6, wherein said substratum is plastic.

10. The electrical plug of claim 6, wherein said contact surfaces are co-planar.

11. The electrical plug of claim 7, wherein said substratum is removable from said housing.

12. An electrical plug adapted to receive an electrical receptacle having a plurality of spaced apart terminals, said electrical plug comprising:

a housing having first and second longitudinal openings therein;

a first longitudinal wafer removably disposed in said first longitudinal opening and defining a first terminal surface;

a second longitudinal wafer removably disposed in said second longitudinal opening and defining a second terminal surface; and each of said wafers having a plurality of terminals disposed in respective said terminal surfaces, each of said terminals defining a contact surface, and a groove defining lateral sidewalls extending from said contact surfaces, said grooves having a predetermined depth from said contact surface such that each said contact surface is raised with respect to said terminal surfaces to define an elevated area wherein each said contact surface extends the entire width of said elevated area.

13. The electrical plug of claim 12, wherein each said sidewall is angled such that each said groove is substantially V-shaped.

14. The electrical plug of claim 12, wherein said predetermined depth is greater than one-half of the thickness of said terminals below said substratum surface.

15. An electrical terminal carrier comprising:

a substratum defining an upper surface, a front, a rear, and first and second sides;

a plurality of contact terminals disposed on said upper surface, each said contact terminal extending a distance from said front to said rear, and defining a contact surface coplanar with said upper surface; and a channel disposed in said upper surface adjacent each one of said plurality of contact terminals, each said channel defining lateral sidewalls and a lower surface wherein each said lateral sidewall extends from an edge of said contact surface to said lower surface, such that each said contact surface is raised from said lower surface defining an elevated area wherein each said contact surface extends the entire width of said elevated area.

16. The electrical terminal carrier of claim 15, wherein said lateral sidewalls are angled such that said channels are a modified V-shape.

17. The electrical terminal carrier of claim 15, wherein said channels extend from said front to said rear of said substratum.

18. The electrical terminal carrier of claim 15, wherein said terminals are parallel to each other and said channels.

* * * * *

UNITED STATES PATENT AND TRADEMARK OFFICE

CERTIFICATE OF CORRECTION

PATENT NO. : 5,795,194

DATED : August 18, 1998

INVENTOR(S) : Marlyn E. Hahn

It is certified that error appears in the above-identified patent and that said Letters Patent is hereby corrected as shown below:

In column 5, line 45, after "terminal contacts" insert --, and wherein each of said terminal contacts has a height greater than a depth of said channel--.

In column 6, line 6, after "elevated area" insert --, and wherein each of said terminal contacts has a height greater than a depth of said notch--; line 38, after "elevated area" insert --, and wherein each of said terminals has a height greater than said predetermined depth of said groov--; and line 60, after "area" insert --, and wherein each of said contact terminals has a height greater than a depth of said channel--.

Signed and Sealed this

Twenty-seventh Day of July, 1999

*Attest:*

Q. TODD DICKINSON

*Attesting Officer*

*Acting Commissioner of Patents and Trademarks*